United States Patent [19]

Gemma et al.

[11] 4,346,564

[45] Aug. 31, 1982

[54] DEFROSTING CONTROL APPARATUS

[75] Inventors: Mario Gemma, Linkenheim-Hochstetten; Burghard Baehr, Berg-Gladbach, both of Fed. Rep. of Germany

[73] Assignee: Ranco Incorporated, Dublin, Ohio

[21] Appl. No.: 135,546

[22] Filed: Mar. 31, 1980

[51] Int. Cl.[3] ..... F25D 21/02

[52] U.S. Cl. ..... 62/140; 62/155

[58] Field of Search ..... 62/128, 140, 158, 155, 62/234

[56] References Cited

U.S. PATENT DOCUMENTS

| | | | |
|---|---|---|---|
| 2,180,071 | 11/1939 | Smith | 62/140 X |
| 2,713,249 | 7/1955 | Schordine | 62/155 |
| 3,350,894 | 11/1967 | Thorner | 62/140 |
| 3,546,894 | 12/1970 | Esche | 62/140 |

*Primary Examiner*—Albert J. Makay
*Assistant Examiner*—Harry Tanner
*Attorney, Agent, or Firm*—Watts, Hoffmann, Fisher & Heinke Co.

[57] ABSTRACT

The accumulation of ice on a surface such as an evaporator fin in a refrigerator unit is detected by a mechanical probe which is moved by a bimetal bender element upon periodic timer-controlled energization of a bimetal heater so as to pass over the surfaces of an evaporator fin. If the movement of the probe is obstructed by ice on the evaporator fin surfaces a switch is operated by a bistable mechanism, causing energization of a defrosting heater and switching off the refrigerator compressor motor. If no ice is detected the probe returns to its original reset position without operating the defrost control switch.

14 Claims, 6 Drawing Figures

Fig. 4A. RESET POSITION
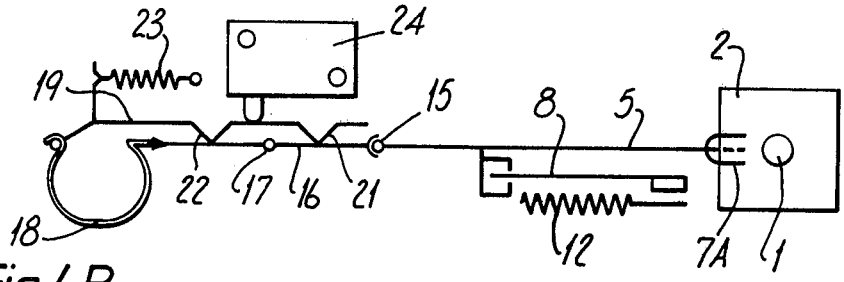
Fig. 4B. ICE BUILD-UP INSUFFICIENT TO JUSTIFY DEFROST
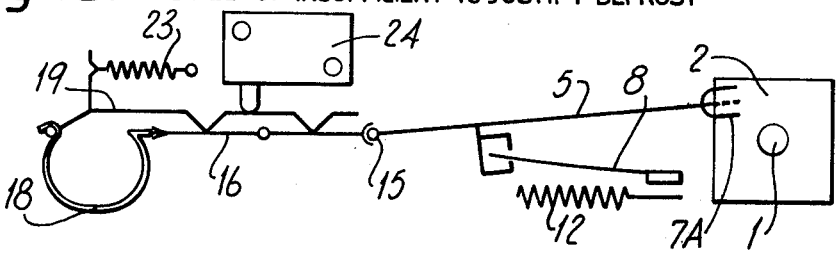
Fig. 4C. ICE BUILD-UP REQUIRE DEFROST
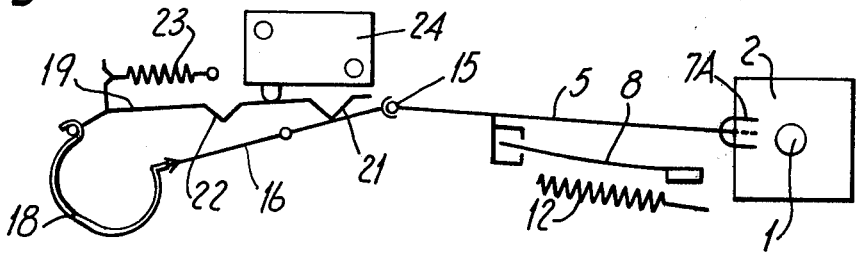
Fig. 4D. ICE BUILD-UP PREVENT FINGER RESET
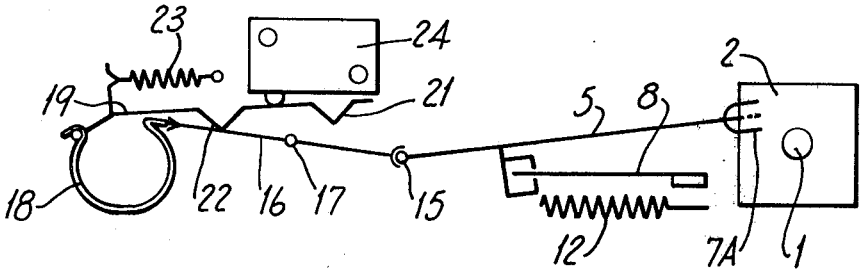

DEFROSTING CONTROL APPARATUS

This invention relates to a defrosting control apparatus.

In refrigerating apparatus such as deep freeze display cabinets and the like it is common to employ automatic defrosting devices. Such devices operate periodically to switch off the compressor of an associated refrigerator unit and simultaneously switch on a defrosting heater which melts any ice which has accumulated on the evaporator of the refrigerator. Such defrosting controls may operate automatically under the control of a timer switch which cuts in the defrosting heater at predetermined intervals for a time sufficient to cause defrosting of the associated evaporator or evaporators of the refrigeration unit.

A disadvantage of such known automatic defrosting controls is that they take no account of the rate of ice accumulation on the evaporator, which will be dependent, inter alia, upon the humidity of the ambient air. A automatic defrosting control will switch on the defrosting heater irrespective of whether or not any ice has accumulated on the evaporator. This, as well as being counter-productive to the overall refrigeration efficiency, is wasteful of electricity, since the defrosting heater would typically have a power rating of 3 kilowatts. Moreover, if a number of refrigeration units are connected to a common defrosting control, as is often the case in a commercial installation, the simultaneous cutting-in of all the defrosting heaters could overload the electrical power supply.

An object of the present invention is to provide a 'demand' defrosting control capable of detecting the presence of ice upon a surface prone to icing, to initiate defrosting only when icing is detected.

Arrangements which have been proposed for detecting the accumulation of ice upon an evaporator for the purpose of controlling defrosting include, for example, the optical sensing of ice, or the detection of increased weight due to the accumulation of ice. Such arrangements are in general unreliable or too complex to be commercially acceptable.

According to the present invention there is provided a defrosting control apparatus comprising a mechanical probe which is movable under control of actuator means relative to a surface which is prone to ice accretion, means for cyclically energising the actuator means, and a switch operatively associated with the probe for controlling the operation of a defrosting heater according to whether or not the movement of the probe is obstructed by ice accretion on the surface.

In one embodiment of the invention the switch is a cut-out switch positioned so as to be operated by the probe when the latter completes a working stroke unobstructed by ice accretion on the said surface, to de-energise the defrosting heater.

The apparatus of the invention has the advantage of technical simplicity, since it relies upon a purely mechanical probe for detecting the presence of ice. Preferably the mechanical probe comprises an angularly displaceable arm to which a feeler element is removably attached. By fitting a feeler element of appropriate dimensions it is possible to predetermine the clearance between the feeler element and the surface being monitored by the apparatus, and thereby predetermine the thickness of ice accretion which will arrest the probe in its movement relative to the surface.

The invention is particularly, but not exclusively, applicable to the control of refrigeration units, especially commercial refrigerators having finned evaporators which are prone to icing.

The apparatus of the invention may be provided with a simple electromechanical switching arrangement. For example the actuator may be energised periodically by a mechanical or electronic timer which operates a changeover switch to switch off a refrigerator compressor and simultaneously switch on the defrosting heater, the cut-out switch, upon being operated by the probe, also switching the said compressor. With such an arrangement the operation of the cut-out switch by the probe upon completion of a working stroke of the probe, that is, in the absence of an ice accretion on the surface or surfaces being monitored, results in the energisation of the compressor during the period which the changeover switch is operated by the timer. Alternatively the operation of the probe actuator may be controlled by an electronic switching control circuit which provides periodic pulses for energising the actuator, the probe being resiliently biased to return to its initial position upon deenergisation of the actuator, and the defrosting heater being energised automatically upon failure of the probe to operate the cut-out switch. The electronic control circuit ensures that the defrosting heater is energised only when the probe detects icing of the surface or surfaces being monitored.

Such a simple embodiment of the invention, in which the probe cooperates with a cut-out switch and is biased to return to its initial position after the energisation of the actuator, can prove to be unreliable in operation. In the first place, the probe may not be capable of detecting powdery or crystalline accumulations of frost, which may offer such a low resistance to the movement of the probe that they are simply brushed aside by the probe and fail to obstruct its movement. Secondly, the probe, after being arrested by ice may be released by partial melting of the ice to operate the cut-out switch and terminate the defrosting prematurely. Thirdly, the probe may become stuck in its 'reset' position in which it operates the cut-out switch, inhibiting any further defrosting cycles.

A preferred embodiment of the present invention avoids the above mentioned disadvantages by providing a defrost control apparatus comprising a mechanical probe which is movable under control of actuator means relative to a surface which is prone to ice accretion, means for cyclically energising the actuator means, a bistable switch operating mechanism connected to the probe and operable into a stable state by the actuator means when the probe is arrested by ice accretion on said surface, and a switch operable by the said mechanism for controlling a defrosting heater.

By using a bistable switch operating mechanism it can be arranged that the force required to arrest the probe and trip the bistable mechanism is very small, enabling the probe to detect accumulations of 'soft' frost. Moreover, immediately the bistable mechanism has tripped, following the arrest of the probe, the force exerted by the probe on the ice accretion falls dramatically, avoiding any tendency for the probe to 'creep' progressively through accumulated ice.

The mechanical probe in the aforesaid preferred embodiment of the invention may comprise a pivoted arm having a floating pivot at one end and at least one finger at its other end adapted to move relative to the surface to be monitored for ice accretion, the floating pivot being carried at one end of a second pivoted arm which forms part of the bistable switch operating mechanism, the said pivot being moved into one stable position or the other when the probe arm is moved by the actuator means with its finger or fingers arrested by ice accretion.

The actuator means may comprised a bimetal bender element having an associated electrical heater. In a simple version of the apparatus the bimetal bender element forms part of the mechanical probe itself and carries at least one ice sensing finger at one end arranged to move relative to the surface to be monitored upon flexing of the bimetal element, the other end of the bimetal element cooperating with the switch and with a bistable thrust spring, and including a stop engaged by the said other end of the bimetal element in the unheated condition of the latter, so that in the event of the finger or fingers being arrested by ice accretion on the surface the other end of the bimetal element moves away from the said stop into a stable position in which the switch is operated.

The means for cyclically energising the actuator means preferably comprise a timer-controlled switching device which periodically operates the actuator means to cause the mechanical probe to move from a rest position relative to the surface to be monitored and to return to its rest position unless its movement is obstructed, obstruction of the probe causing the switch to be operated by the bistable operating mechanism to open a first pair of contacts which in use of the apparatus supply power to a compressor of a refrigerator and to close a second pair of contacts which in use of the apparatus supply power to an electrical defrosting heater. The timercontrolled switching device preferably includes a temperature-responsive switch which responds to a predetermined temperature increase in equipment to be defrosted to switch off the defrosting heater.

The invention will be further described, by way of example, with reference to the accompanying purely diagrammatic drawings, in which.

Figure 3:
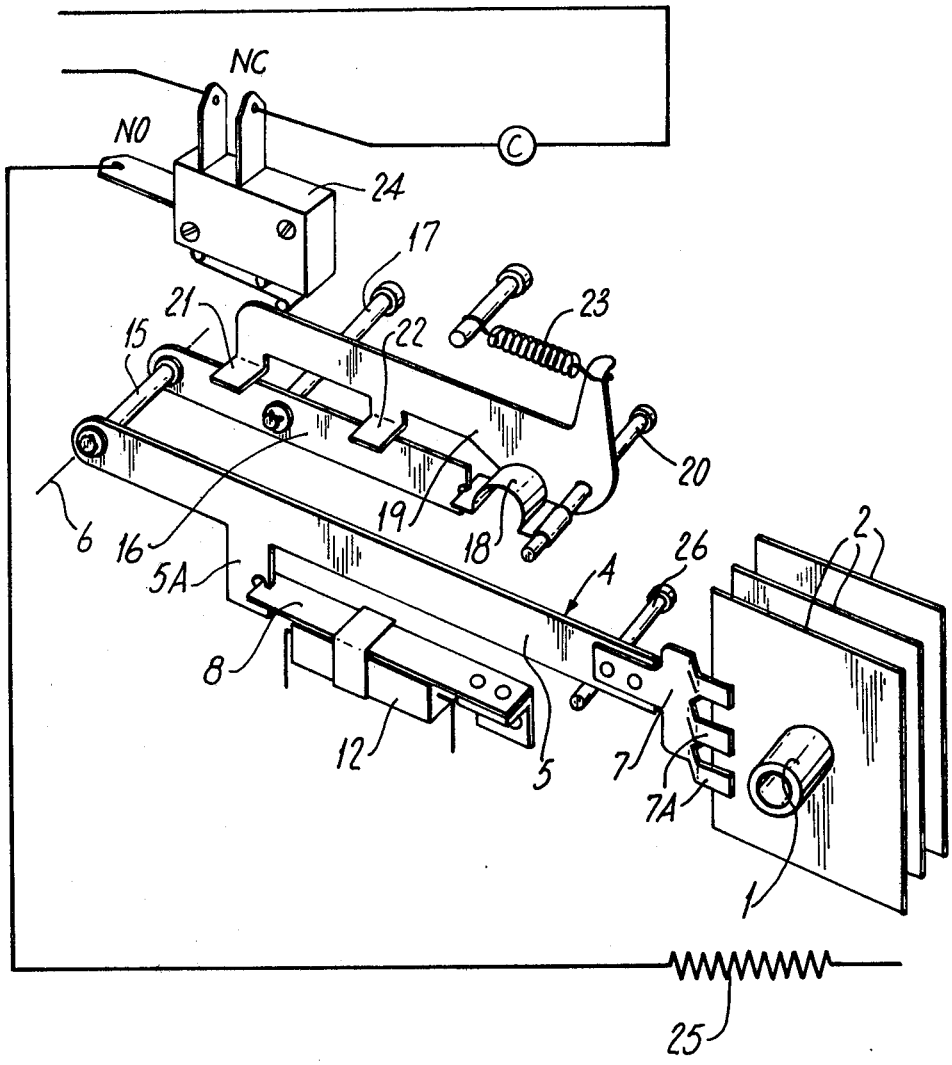
FIG. 3 is a diagrammatic perspective view illustrating the general arrangement of a defrost control apparatus according to a preferred embodiment of the invention.
Figure 5:
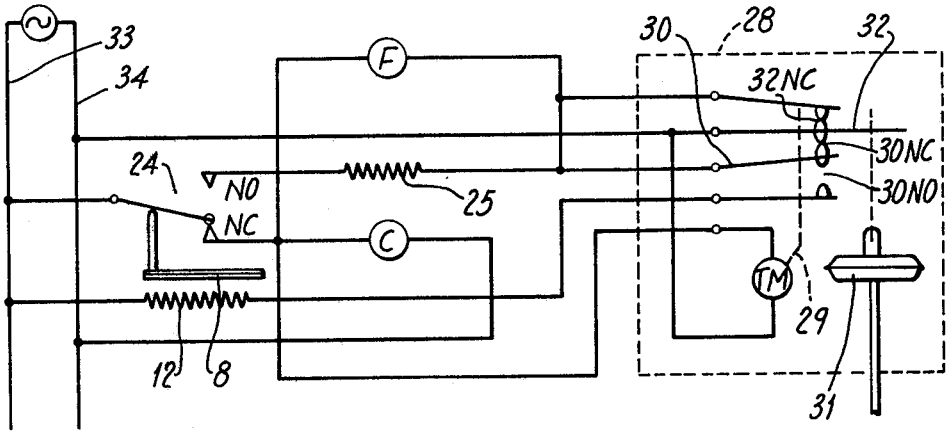
Figure 6:
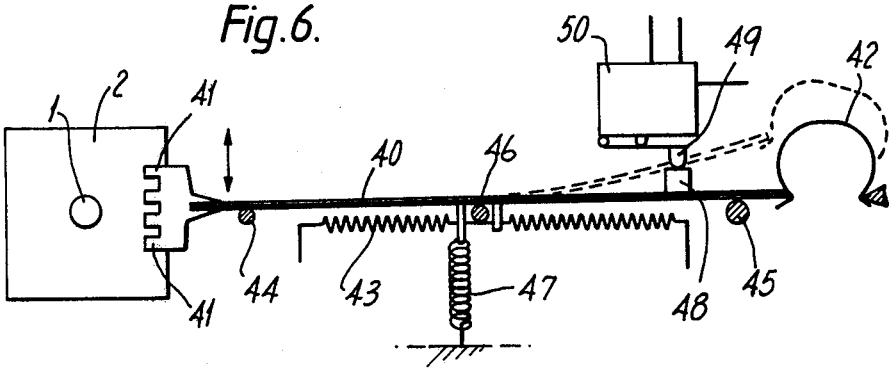

FIGS. 4 A–D are schematic representations of the apparatus of FIG. 3 in four different operative states;

FIG. 5 is a circuit diagram of apparatus as illustrated in FIGS. 3 and 4 connected to a timercontrolled switching device, and FIG. 6 is a diagrammatic side view of a simplified variant of the defrost control apparatus according to the invention.

The apparatus illustrated in the drawings is associated with a refrigeration unit and is designed to control the periodic defrosting of an evaporator having a finned tube 1, two adjacent parallel fins 2 of which are shown diagrammatically. The fins 2 are exposed to the air to absorb heat, and in the course of operation these fins 2 become coated with ice, rendering the evaporator progressively less efficient. It is necessary, therefore, to defrost the evaporator periodically by switching off the compressor of the refrigeration unit and simultaneously energising an electrical defrosting heater 3, shown diagrammatically, which heats the evaporator to a temperature just above freezing, melting the ice which has accumulated on the evaporator fins. The water resulting from the melting of the ice is collected in a drip tray (not shown) located beneath the evaporator.

In a conventional automatic defrosting control apparatus for a commercial refrigerator the defrosting cycle is initiated automatically at timed intervals by a timer switch. The timer switch may energise the defrosting heater 3 for a predetermined time interval in each defrost cycle, or alternatively a thermostatic sensor may be associated with the evaporator to cut out the defrosting heater and re-energise the refrigerator compressor when the temperature of the evaporator rises above the freezing temperature.

The apparatus of the present invention is associated with a periodically energised electrical defrosting heater and acts to prevent the unnecessary energisation of the defrosting heater in the absence of an accretion of ice on the evaporator surfaces.

Figure 1:
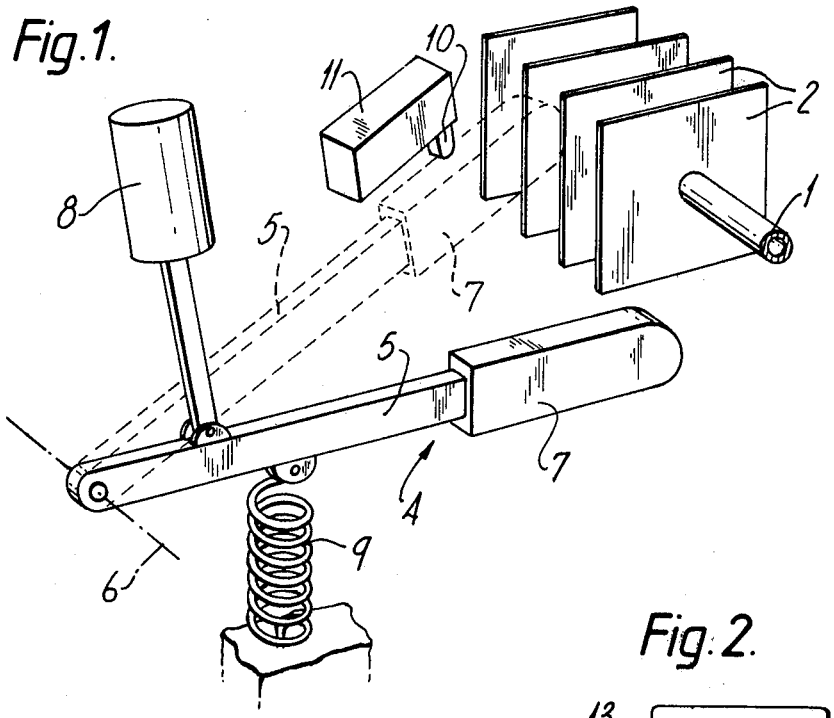
FIG. 1 is a schematic perspective view of a defrosting control apparatus according to one embodiment of the invention.

The embodiment of the invention illustrated in FIG. 1 includes a mechanical probe 4 comprising an angularly displaceable arm 5 pivoted at one end about a fixed axis 6 and carrying at its free end a removable feeler element 7. The feeler element 7 may be a plastic cap or sleeve fitted over the free end of the arm 5. The probe is positioned so that upon angular displacement of the probe arm 5 the feeler element 7 moves in an arc and passes between two adjacent fins 2 of the evaporator with a predetermined clearance from the opposing parallel surfaces of the fins 2. The probe 4 is movable from an initial position, shown in FIGS. 1 and 2, in which the feeler element 7 is clear of the evaporator fins 2, and a final position, shown in broken outline, in which the feeler element 7 is again clear of the evaporator fins 2, having passed in a working stroke through the gap between the two aforesaid fins 2.

The working stroke of the probe 4 is effected by an actuator comprising a solenoid 8 acting upon the probe arm 5 in opposition to a helical biasing spring 9. Any other convenient form of probe actuator may be employed, including for example, a bimetal actuator associated with an electrical heater.

Figure 2:
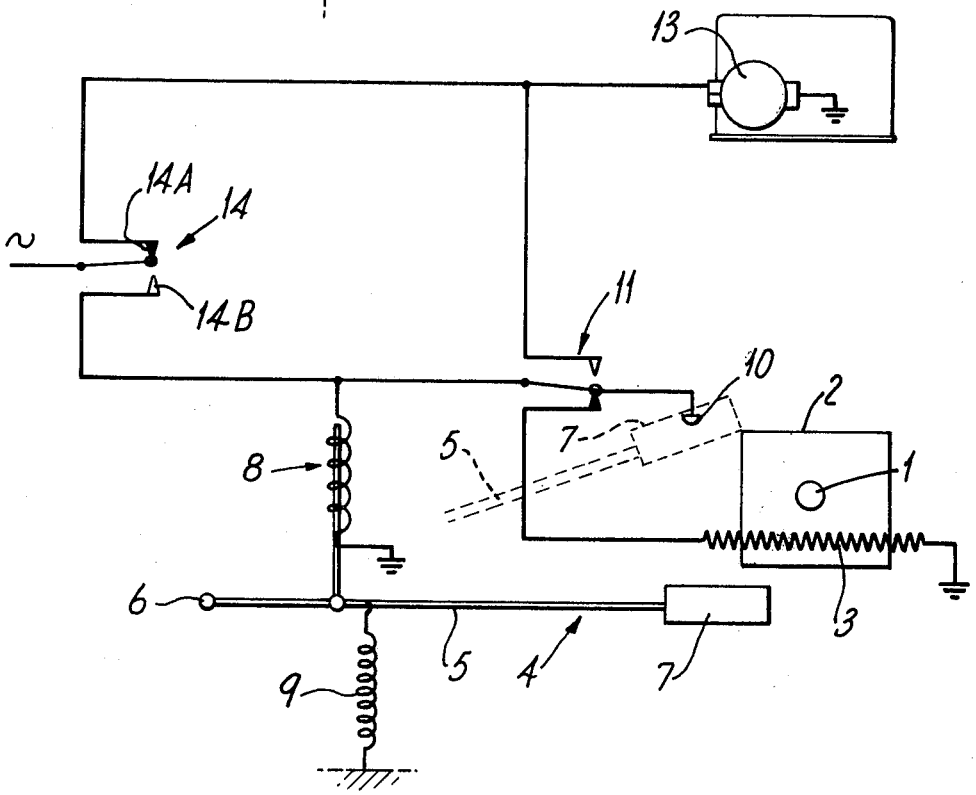
FIG. 2 is a circuit diagram of the apparatus shown in FIG. 1.

If and when the probe 4 reaches its final position by completing its working stroke, the feeler element 7, or some other convenient part of the mechanical probe, engages the operating member 10 of a cut-out microswitch 11 which is connected to a control circuit of the associated refrigerator unit, as shown diagrammatically in FIG. 2.

Referring to FIG. 2, the cut-out switch 11 has a changeover function, with normally closed contacts connected to the defrosting heater 3 and normally open contacts of the switch 11 are connected to the compressor motor 13 of the refrigerator. The movable contact of the switch 11 is connected to a timer switch 14 which the solenoid 8 is also connected to, in parallel with the switch 11. The timer switch 14 may be of the mechanical type and operates automatically at predetermined and presettable intervals, the contacts 14A of the timer switch being normally closed and the contacts 14B of the timer switch 14 being normally open, but being closed periodically at the said predetermined intervals for a length of time sufficient to effect defrosting of the evaporator. The contacts 14A of the timer switch 14 are connected to the compressor motor 13, while the contacts 14B are connected to the moving contact of the switch 11.

In operation of the circuit shown in FIG. 2 the common contact of the timer switch 14 is connected to a mains power supply, the normally closed contacts 14A of the timer switch 14 connecting this power supply to the compressor motor 13. At predetermined timed intervals the timer switch 14 is operated to close the contacts 14B and open the contacts 14A. This results in energisation of the solenoid 8 and at the same time supplies power through the normally closed contacts of the cut-out switch 11 to the defrost heater 3. Upon energisation the solenoid 8 lifts the probe arm 5, against the action of the biasing spring 9, and causes the feeler element 7 to pass between the two evaporator fins 2: if there is an ice accumulation on the evaporator fins 2 greater in thickness than the clearance gaps between the surfaces of the fins 2 and the feeler element 7 the feeler element 7 is arrested and does not come into engagement with the operating member 10 of the switch 11. In this case the switch 11 is not operated and the energisation of the defrosting heater 3 is maintained until the end of the interval timed by the timer switch 14, or until the accumulated ice on the evaporator fins has melted sufficiently to allow the feeler element 7 to pass between the fins and operate the changeover switch 11.

Upon operation of the cut-out switch 11 by the feeler element 7 the timer switch contacts 14 are connected to the compressor motor 13, and the defrosting heater 3 is de-energised. Thus if upon initial operation of the timer switch 14 there is no appreciable accretion of ice on the evaporator fins 2 the cut-out switch 11 is operated immediately by the feeler element 7, and the defrosting heater 3 is de-energised, and the compressor motor 13 restarted, immediately after operation of the timer switch 14. Alternatively, if the accumulated ice upon the evaporator fins 2 melts before the end of the interval timed by the timer switch 14 the feeler element 7 will operate the cut-out switch 11 and cause re-energisation of the compressor motor 13 and de-energisation of the defrosting heater 12.

By fitting to the probe arm 4 a feeler element 7 of appropriate thickness in relation to the gap between the evaporator fins 2, or in relation to any other surface or surfaces to be monitored, it is possible to predispose the apparatus to signal the accretion of ice of any predetermined thickness.

In an alternative system, not illustrated, the defrost cycle may be controlled electronically, for example using an appropriate logic circuit which, at predetermined intervals, 'interrogates' the system and controls the operation of the defrosting heater according to whether or not ice is detected by the mechanical probe. Thus the circuit may effect energisation of the actuator momentarily, to move the mechanical probe through its operating stroke from its initial position, after counting or storing a predetermined number of clock pulses. If the probe moves through its full operating stroke, unobstructed by ice, it operates a microswitch which resets or clears the pulse store, which thereupon recommences the counting of clock pulses until the next periodic energisation of the actuator. If, on the other hand, the probe is obstructed by ice and fails to operate the microswitch automatic energisation of the defrosting heater ensues. With this arrangement the mechanical probe is returned by a biasing spring to its initial position immediately the operating solenoid is de-energised, avoiding any likelihood of the probe becoming embedded in ice accumulated on the surfaces being monitored.

FIG. 3 is a diagrammatic perspective view of a defrost control apparatus according to a preferred embodiment of the invention for the defrosting as required of an evaporator of a refrigeration apparatus. The evaporator has a pipe 1, part of which is shown, upon which cooling fins 2 are mounted, in a conventional manner. The apparatus has a mechanical probe 4 comprising a pivoted arm 5 supported for pivotal movement about a floating pivot axis 6 at one end of the arm 5. The free end of the probe arm 5 is provided with a comb structure 7 having fingers **7*a* which embrace an edge of one of the fins 2 of the evaporator so that upon pivotal movement of the probe arm 5 about its pivot axis 6 the fingers 7*a* move parallel to opposite faces of the said fin 2**, close to the surfaces of the latter.

Pivotal movement of the probe arm 5 is effected by means of a bimetal bender element 8 anchored at one end and drivingly connected at its free end to a leg **5*a* depending from the probe arm 5. An electrical heater element 12 is arranged in good thermal contact with the bimetal element 8**.

The floating pivot axis 6 of the probe arm 5 is defined by a pin 15 carried at the free end of a second pivoted arm 16 which is pivoted intermediate its ends about a fixed pivot pin 17. The other end of the second arm 16 is engaged by a thrust spring 18 which in this case comprises an omega shaped spring strip.

An L-shaped rocker lever 19 is pivoted at its elbow about a fixed pivot pin 20, which also serves as an anchorage for one end of the spring 18. One arm of the lever 19, extending generally parallel to the second arm 16, has two integral lugs 21, 22 engageable with the second arm 16 on opposite sides of the pivot axis of the latter. The other arm of the L-shaped rocker lever 19, shown upstanding in FIG. 3, is acted upon by a helical tension spring 23.

The end of the rocker lever 19 adjacent the lug 21 cooperates with the operating member of a switch 24. In the illustrated embodiment the switch 24 is a normally open switch and controls the operation of a defrost heater 25, shown diagrammatically in FIG. 3, arranged in proximity to the evaporator for the purpose of defrosting the latter.

The second arm 16 carrying the floating pivot of the probe arm 5 and the omega shaped tension spring 18 together form a bistable switch operating mechanism having two stable states in which the line of action of the spring 18 respectively passes to one side or the other of the pivot axis of the arm 16.

In operation of the apparatus the bimetal heater 12 is periodically energised for a predetermined time interval, for example under the control of a timer, as described later with reference to FIG. 5. This causes the probe arm 5 to move angularly about its pivot axis 6, displacing the fingers **7*a* relative to the surfaces of the associated fin 2, the arm 5 returning to its initial rest position, determined by a fixed stop 26. If the angular movement cycle of the probe arm 5 is unobstructed the pivot axis 6 of the probe arm 5 does not move, and the switch 24 is not operated. If, on the other hand, movement of the fingers 7*a* is obstructed by ice or frost on the fin 2 being monitored the probe arm 5 will continue its angular movement, under the influence of the bimetal element 8, by displacing the "floating" pivot pin 15: such displacement of the pivot pin 15, in either direction, will result in a clockwise (as viewed in FIG. 3**)

rocking movement of the lever 19 by engagement of either the lug 21 or the lug 22 by the second pivoted arm 16, such rocking movement resulting in operation of the switch 24, the contacts of which close to energise the defrost heater 25. Defrosting is initiated, therefore, only if a layer of ice or frost has been formed on the fins which is sufficient to obstruct the movement of the fingers *7a*. The fingers *7a* may be adjusted or preselected so as to have a predetermined clearance relative to the surfaces of the fin 2 being monitored, according to the defrosting requirements of the equipment in which the apparatus is installed.

The switch 24 may in addition have a pair of contacts which are normally closed and through which power is normally supplied to the compressor 26 of the associated refrigeration equipment. When the switch 24 is operated to initiate a defrost operation the compressor 26 is simultaneously switched off.

The operation of the apparatus shown in FIG. 3 will be better understood by reference to FIG. 4, which shows the apparatus diagrammatically 'opened out' with the probe arm 5 substantially aligned with the second pivoted arm 16. In the normal running or 'reset' position of the apparatus, shown in FIG. 4A, the bimetal heater 12 is de-energised and the switch 24 is not operated. The periodic cyclic movement of the probe arm 5 under control of the bimetal bender element 8 is illustrated in FIG. 4B, in which the bimetal heater 12 is energised, but there is insufficient accretion of ice on the associated fin 2 to impede the movement of the fingers *7a*, so that the arm 5 moves about the pivot axis 6 without affecting the switch 24. FIG. 4C shows the same condition, with the bimetal heater 12 energised, but where there is a sufficient accretion of ice to arrest the movement of the probe 4 relative to the fin 2: in this case the probe arm 5 pivots under the influence of the bimetal element 8 about the arrested fingers *7a*, displacing the pivot axis 6 and causing the second arm 16 to rock the lever 19 by engagement with the lug 21, operating the switch 24. During this movement the bistable switch operating mechanism snaps into a stable state, shown exaggerated in FIG. 4C, in which the line of action of the omega shaped spring 18 passes to one side of the pivot axis of the arm 16. This in turn exerts a reaction force on the floating pivot connection between the arms 5 and 16 which results in a substantial reduction of the force exerted by the probe fingers *7a* on the accumulated ice, ensuring that the probe remains stuck in the ice until defrosting has been completed.

Should the accretion of ice on the fin surfaces be such as to prevent the return of the probe 4 to its reset position (FIG. 4A) the probe arm will be moved by the bimetal element 8 upon de-energisation of the bimetal heater 12, causing diplacement of the floating pivot 15 to cause rocking of the lever 19 by engagement of the second arm 16 with the lug 22, as shown in FIG. 4D, again resulting in operation of the switch 24. In this position the omega shaped thrust spring 18 has no effect on the lever arm 16 since the line of action of the spring 18 passes virtually through the pivot axis 17 of the arm 16. The mechanism is therefore reset as soon as the probe fingers 7A are free to return to the normal reset position (FIG. 4A). Whereupon, the switch 24 will be released and the compressor C again energised.

In operation of the apparatus illustrated in FIGS. 4 and 5 the bimetal heater 12 is energised periodically for a predetermined time interval by a timer controlled switching device, so that the probe 4 executes a periodic movement cycle to detect the present of accumulated ice on the fin surfaces, initiating a defrost operation only when the ice accumulation is sufficient to arrest the movement of the probe, as described previously.

In some refrigerator installations, for example deep-freeze cabinets of the kind in which air is blown over an evaporator coil before circulating in the interior of the cabinet, an electrically driven fan is associated with the evaporator. During a defrost operation when the compressor of the refrigerator is de-energised and the evaporator defrosting heater is in operation the fan is de-energised. It is important that at the termination of the defrost operation the fan should not be re-energised immediately, since this would result in relatively warm air entering the refrigerated space and giving rise to misting: the fan should be re-started after a delay sufficient for the evaporator coil to reach its operating temperature. FIG. 5 illustrates the circuit of a defrost control apparatus according to the invention associated with a timer control switching device 28 for controlling the sequence of operations described above in a refrigeration unit having an evaporator with an associated fan driven by an electric motor F, the compressor of the refrigerator unit being driven by an electric motor C.

The timer device 28 includes a timer motor TM which through a cam mechanism indicated by the broken line 29 acts upon a movable switch arm 30 associated with normally closed and normally open contact pairs 30 NC and 30 NO respectively. The timer device 28 also includes a temperature responsive element such as a bellows 31 which acts upon a movable switch arm 32 associated with normally closed switch contacts 32 NC and also with the previously mentioned normally closed contacts 30 NC. In the circuit of FIG. 5 the normally closed and normally open contact pairs of the switch 24 are designated 24 NC and 24 NO respectively. Power is supplied to the apparatus through alternating current supply lines 33, 34.

In the normal running condition of the refrigeration unit the switch contacts 24 NC are closed and power is supplied to the fan and compressor motors F, C, the evaporator heater 25 being de-energised and the timer motor TM being energised, as illustrated in FIG. 5.

After a predetermined time interval the timer initiates an ice sensing cycle by moving the switch arms 30 and 32 so as to open the contacts 22 NC and close the contacts 30 NO. This energises the bimetal heater 12, causing the bimetal element 8 to move the probe arm 5 through an ice sensing cycle. If there is insufficient ice on the fin surfaces to arrest the movement of the probe the probe will return to its original reset position when the bimetal heater 12 is de-energised at the end of the predetermined time interval determined by the timer, without having operated the switch 24, and the timer contacts will revert to the positions shown in FIG. 5, allowing the system to run uninterruptedly until the next ice sensing cycle. Ice sensing cycles are repeated at regular intervals under control of the timer, without affecting the operation of the refrigerator, until ice is detected by the probe 4. If the probe 4 is arrested by accumulated ice on the fin surfaces the switch 24 is operated to close the contacts 24 NO and open the contacts 24 NC, while the timer contacts 30 NC and 30 NO are both closed. This results in switching off of the compressor motor C and the fan motor F and switching on of the evaporator heater 25, so that defrosting of the evaporator commences. The timer motor TM is also de-energised, leaving the timer contacts 30 NC and 30

NO closed, so that the bimetal heater 12 remains energised, maintaining the bistable switch operating mechanism in the state illustrated diagrammatically in FIG. 4C. The defrost operation continues until the evaporator reaches a temperature just above freezing, as detected by the temperature responsive device 31, which then acts upon the switch arm 32, closing the contacts 32 NC and opening the contacts 30 NC, while the contacts 30 NO remain closed. The opening of the contacts 30 NC causes de-energisation of the bimetal heater 12, so that the bimetal bender element 8 then reverts to its reset position (FIG. 4A), causing the switch 24 to resume its normally closed position, with the contacts 24 NO open. This simultaneously de-energises the evaporator heater 25 and switches on the compressor motor C. At the same time the timer motor TM is re-energised, and times a further predetermined "fan delay" interval, at the end of which the timer motor displaces the two switch arms 30, 32, closing the contacts 32 NC and 30 NC, and opening contacts 30 NO. This switches on the fan motor F and the system reverts to the normal condition illustrated in FIG. 5 when the temperature responsive device 31 resets, upon the evaporator reaching its normal running temperature.

In the event of the ice sensing probe becoming stuck by an ice accretion on the fin surfaces preventing reset of the probe arm 5 the timer contacts will revert to their normal running conditions, illustrated in FIG. 5, at the end of the timed periodic energisation of the bimetal heater 12, and the bimetal element 8 will revert to its normal, unheated, condition. This will cause the probe arm 5 to pivot about the obstructed end, displacing the floating pivot 6 and causing operation of the switch 24, as illustrated in FIG. 4D, so that the contacts 24 NC open and the contacts 24 NO close. This will switch off the compressor C and switch on the evaporator heater 25. This state of affairs will continue until the ice on the evaporator fin surfaces has melted, allowing the probe arm 5 to revert to its normal reset position (FIG. 4A) when the switch 24 will again assume its normal running condition illustrated in FIG. 5.

FIG. 6 illustrates, by way of further example, a simplified version of a defrost control apparatus according to the invention in which the ice sensing probe and the actuator for moving the probe are combined in a single bimetal bender element 40. The bimetal element 40 carries at one end a comb structure formed with ice sensing fingers 41, the other end of the bimetal element 40 being engaged by a bistable omega shaped thrust spring 42. An electrical resistive heating element 43 is arranged in thermal contact with the bimetal element 40 which, in the unheated state, is substantially flat as shown and rests on end stops 44, 45 adjacent opposite ends of the bimetal element 40. The bimetal element 40 is restrained resiliently against a central stop 46 by a tension spring 47. A switch operating projection 48 is provided on the bimetal strip 40 adjacent the end of the latter which engages the bistable spring 42. The projection 48 cooperates with the operating member 49 of a switch 50 which, like the switch 24 in the embodiment of FIG. 3, controls the power supply to an evaporator defrosting heater and a compressor motor alternatively.

In operation of the apparatus illustrated in FIG. 6 the bimetal heater 43 is energised periodically under control of a timer, as described previously, for predetermined time intervals, during which the bimetal element 40 flexes (upwardly in FIG. 6), causing the fingers 41 to travel over the associated surfaces of an evaporator fin 2. If no ice is encountered the movement of the fingers 41 is unimpeded, and the bimetal element 40 reverts to its original flat condition, illustrated in FIG. 6, without operating the switch 50, and without therefore initiating a defrost operation. If, on the other hand, the movement of the ice sensing fingers 41 is impeded by ice accretion on the fin surfaces the continued energisation of the bimetal heater 43 will cause the bimetal element 40 to flex upwardly at the end which is engaged by the bistable spring 42, until the latter snap engages into a stable position, shown in broken outline, in which this end of the bimetal element 40 is clear of the stop 45, and the switch 50 is operated.

As in the embodiment described with reference to FIGS. 3 and 4, the snapping of the bistable spring 42 into its stable state will cause a sharp decrease in the reaction force exerted by the finger 41 on the ice accretions. This in turn ensures that the finger 41 remains trapped and does not 'creep' through the ice accretion as the ice progressively melts. The bistable spring 42 maintains the bimetal element 40 in this operative position until the timer de-energises the bimetal heater 43, allowing the bimetal element 40 to revert to its flat reset position, shown in FIG. 6.

It will be appreciated that the invention, although described with particular reference to the defrosting control of evaporators in refrigerator circuits, is also applicable to other installations, for example heat exchangers or vaporizers, in which it may be desired to monitor surfaces which are prone to icing in use and to initiate de-icing when the ice accretion reaches a critical thickness.

We claim:

1. In a defrost control apparatus, a mechanical probe comprising an arm movable about a pivot and having a probe region disposed adjacent a surface prone to ice accretion, actuator means for effecting movement of the probe region relative to said surface about said pivot, means for cyclically energising the actuator means, and a switch operatively associated with the probe for controlling the operation of a defrosting heater, said pivot supported for shifting movement by said actuator means when pivotal movement of the probe is obstructed by ice accretion on the surface, shifting movement of said pivot and probe effecting operation of said switch.

2. Apparatus as claimed in claim 1 in which a feeler element is removably attached to said arm to form said probe region.

3. Apparatus as claimed in claim 1, in which the probe is movable in its working stroke between opposing parallel surfaces of adjacent fins on an evaporator or heat exchanger tube prone to icing.

4. A defrost control apparatus comprising an elongated mechanical probe having an end region disposed adjacent a surface which is prone to ice accretion, said end region movable along a path adjacent said surface for engagement with ice formed thereon, said probe including a second region spaced from said end region which is supported for movement relative to said end region, actuator means for effecting movement of the probe end region relative to said surface, means for cyclically energising the actuator means, a bistable switch operating mechanism connected to the probe and operable into a stable state by movement of said second probe region relative to the probe end region by the actuator means when the probe end region movement is arrested by ice accretion on said surface, and a switch operable by the said mechanism for controlling defrosting of said surface.

5. A defrost control apparatus comprising a mechanical probe comprising a pivoted arm having a floating pivot at one end and at least one finger at its other end adapted to move relative to a surface to be monitored for ice accretion, actuator means for effecting movement of the probe relative to a surface which is prone to ice accretion, means for cyclically energising the actuator means, a bistable switch operating mechanism connected to the probe and operable into a stable state by the actuator means when the probe is arrested by ice accretion on said surface, said bistable switch operating mechanism comprising a second pivoted arm with said floating pivot carried at one end thereof, and a switch operable by the said mechanism for controlling a defrosting heater, said floating pivot being moved into one stable position or the other when the probe arm is moved by the actuator means with a finger arrested by ice accretion.

6. Apparatus according to claim 5, in which a thrust spring acts upon the other end of the second pivoted arm, the line of action of the thrust spring passing through the pivot axis of the said second arm upon movement of the arm from one stable position to the other.

7. Apparatus according to claim 5 or claim 6 in which the second pivoted arm acts upon the switch through a rocker lever pivoted at one end and engageable with the second arm alternatively at two positions on opposite sides of the pivot axis of the second arm.

8. Apparatus according to claim 1 or claim 4, in which the actuator means comprises a bimetal bender element having an associated electrical heater.

9. Apparatus according to claim 1 or claim 4, in which the probe end region is provided with a comb structure having fingers which upon movement of the probe embrace an edge of a fin or other element upon which ice may form.

10. Apparatus according to claim 4, in which the mechanical probe is formed by a bimetal bender element with said end region arranged to move relative to the surface to be monitored upon bending of the bimetal element, said second probe region formed by the other end of the bimetal element and cooperating with the switch and with a bistable thrust spring, and including a stop engaged by the said other end of the bimetal element in the unheated condition of the latter, so that in the event of the probe being arrested by ice accretion on the surface the other end of the bimetal element moves away from the said stop into a stable position in which the switch is operated.

11. Apparatus according to claim 4, in which the means for cyclically energising the actuator means comprises a timer-controlled switching device which periodically operates the actuator means to cause the mechanical probe to move from a rest position relative to the surface to be monitored and to return to its rest position unless its movement is obstructed, obstruction of the probe causing the switch to be operated by the bistable operating mechanism to open a first pair of contacts which in use of the apparatus supply power to a compressor of a refrigerator and to close a second pair of contacts which in use of the apparatus supply power to an electrical defrosting heater.

12. Apparatus according to claim 11, in which the timer-controlled switching device includes a temperature-responsive switch which responds to a predetermined temperature increase in equipment to be defrosted to switch off the defrosting heater.

13. Apparatus according to claim 12, in which the timer controlled switching device is energised, upon the return of the switch to its original position following a defrosting sequence, to time a delay interval following which a fan associated with the defrosted equipment is energised.

14. A defrost control apparatus comprising defrost heating means, a mechanical probe, actuator means for moving the probe relative to a surface which is prone to ice accretion and which is heated in response to energization of the defrost heating means, means for cyclically energising the actuator means, a bistable switch operating mechanism connected to the probe and operable into a stable state by the actuator means when movement of the probe by the actuator means is arrested by ice accretion on said surface, the said switch operating mechanism, when operated into said stable state, causing a sharp reduction in the reactive force exerted by the probe on said ice accretion, and a switch operable by said mechanism for controlling the operation of the defrost heating means.

* * * * *